US011589161B2

(12) United States Patent
Irii et al.

(10) Patent No.: US 11,589,161 B2
(45) Date of Patent: Feb. 21, 2023

(54) ELECTROSTATIC ELECTROACOUSTIC TRANSDUCER DEVICE, SIGNAL PROCESSING CIRCUIT FOR ELECTROSTATIC ELECTROACOUSTIC TRANSDUCER, SIGNAL PROCESSING METHOD, AND SIGNAL PROCESSING

(71) Applicant: Audio-Technica Corporation, Tokyo (JP)

(72) Inventors: Koichi Irii, Kanagawa (JP); Hiroshi Akino, Kanagawa (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 27 days.

(21) Appl. No.: 17/282,470

(22) PCT Filed: Sep. 5, 2019

(86) PCT No.: PCT/JP2019/035095
§ 371 (c)(1),
(2) Date: Apr. 2, 2021

(87) PCT Pub. No.: WO2020/071052
PCT Pub. Date: Apr. 9, 2020

(65) Prior Publication Data

US 2021/0385576 A1 Dec. 9, 2021

(30) Foreign Application Priority Data

Oct. 2, 2018 (JP) ..... JP2018-187504

(51) Int. Cl.
*H04R 3/06* (2006.01)
*H04R 7/16* (2006.01)
*H04R 19/02* (2006.01)

(52) U.S. Cl.
CPC ..... *H04R 3/06* (2013.01); *H04R 7/16* (2013.01); *H04R 19/02* (2013.01)

(58) Field of Classification Search
None
See application file for complete search history.

(56) References Cited

U.S. PATENT DOCUMENTS

2006/0072770 A1 4/2006 Miyazaki
2006/0269095 A1* 11/2006 Matsumura ..... H04R 1/2803 381/421
2017/0284825 A1 10/2017 Lesso et al.

FOREIGN PATENT DOCUMENTS

CN 1709587 A 12/2005
CN 107211218 A 9/2017
(Continued)

*Primary Examiner* — Kenny H Truong
(74) *Attorney, Agent, or Firm* — WCF IP

(57) ABSTRACT

The present invention is a signal processing circuit 12 for an electrostatic electroacoustic transducer configured to correct signals input to a single driven electrostatic electroacoustic transducer 15 including a diaphragm 151 and a fixed electrode 152 disposed to face the diaphragm. The signal processing circuit includes a correction value determiner 122 configured to determine a correction value v1 of a level based on a level of the input signals s1 from the sound source, and a level corrector 124 configured to correct the level of the input signals based on the correction value. The level corrector is configured to correct the level of an input signal among the input signals based on the correction value. The input signal corresponds to a signal for displacing the diaphragm to a first direction side on which a fixed electrode is not disposed with respect to a predetermined position.

14 Claims, 8 Drawing Sheets

(56) References Cited

FOREIGN PATENT DOCUMENTS

| | | | |
|---|---|---|---|
| GB | 2265519 | A | 9/1993 |
| JP | S49-34625 | A | 4/1974 |
| JP | S49-43625 | A | 4/1974 |
| JP | S50-115516 | A | 9/1975 |
| JP | S51-44920 | U | 4/1976 |
| JP | S51-44921 | U | 4/1976 |
| JP | S56-165490 | A | 12/1981 |
| JP | 2010-98712 | A | 4/2010 |
| JP | 2013-013058 | A | 1/2013 |
| JP | 2016-119623 | A | 6/2016 |

* cited by examiner

ELECTROSTATIC ELECTROACOUSTIC TRANSDUCER DEVICE, SIGNAL PROCESSING CIRCUIT FOR ELECTROSTATIC ELECTROACOUSTIC TRANSDUCER, SIGNAL PROCESSING METHOD, AND SIGNAL PROCESSING

TECHNICAL FIELD

The present invention relates to an electrostatic electroacoustic transducer device, a signal processing circuit for an electrostatic electroacoustic transducer, a signal processing method, and a signal processing program. The present invention particularly relates to a driving circuit of a single driven electrostatic electroacoustic transducer including a fixed electrode disposed to face a surface of a diaphragm.

BACKGROUND ART

An electroacoustic transducer converts vibration of air (sound) into an electrical signal, or an electrical signal into vibration of air (sound). Types of the electroacoustic transducer include an electrostatic (condenser type) electroacoustic transducer. The electrostatic electroacoustic transducer includes a diaphragm and a fixed electrode disposed to face the diaphragm. The electrostatic electroacoustic transducer utilizes an electrostatic capacitance between the diaphragm and the fixed electrode or the electrostatic force acting between the diaphragm and the fixed electrode. Therefore, the electrostatic electroacoustic transducer requires a voltage (polarization voltage) to provide a potential difference between the diaphragm and the fixed electrode.

Electrostatic electroacoustic transducers are divided into two types according to a method of adding polarization voltage: a pure condenser type electrostatic electroacoustic transducer and an electret type electrostatic electroacoustic transducer. The pure condenser type electrostatic electroacoustic transducer applies DC voltage (polarization voltage) from an external power supply (polarization power supply) between the diaphragm and the fixed electrode. The electret type electrostatic electroacoustic transducer applies DC voltage (polarization voltage) between the diaphragm and the fixed electrode by holding a charge on the diaphragm or the fixed electrode.

Further, electrostatic electroacoustic transducers are divided into two types according to an arrangement of the fixed electrode: a single driven electrostatic electroacoustic transducer and a push-pull driven electrostatic electroacoustic transducer. In the single driven electrostatic electroacoustic transducer, the fixed electrode is arranged to face a surface of the diaphragm. On the other hand, in the push-pull driven electrostatic electroacoustic transducer, two fixed electrodes are arranged to face both surfaces of the diaphragm with the diaphragm therebetween.

Examples of an audio equipment that converts an electric signal to vibration of air (emitting sound) using such electrostatic electroacoustic transducer include a condenser-type speaker and a condenser-type headphone (earphone).

FIG. 1 is a schematic cross-sectional view illustrating a basic configuration of a conventional single driven electrostatic electroacoustic transducer. The single driven electrostatic electroacoustic transducer includes a diaphragm 1, a fixed electrode 2 having a plurality of openings 2*a*, and a spacer 3. The fixed electrode 2 is disposed to face a surface of the diaphragm 1 through the spacer 3. A signal voltage 4 is supplied between a conductive film (not illustrated) formed on the diaphragm 1 and the fixed electrode 2.

FIG. 2 is a schematic cross-sectional view illustrating a basic configuration of a conventional push-pull driven electrostatic electroacoustic transducer. The push-pull driven electrostatic electroacoustic transducer includes a diaphragm 1, two fixed electrodes 2 having a plurality of openings 2*a*, and two spacers 3. Each of the two fixed electrodes 2 are disposed to face a front surface and a rear surface of the diaphragm 1, respectively, through a spacer 3. A signal voltage 4 is supplied between both fixed electrodes 2.

As described above, in the electrostatic electroacoustic transducer that converts the electric signal into the vibration of air, the diaphragm 1 vibrates by an electrostatic force acting between the diaphragm 1 and the fixed electrode 2. That is, the diaphragm 1 is displaced in a direction (first direction) in which the fixed electrode 2 is not disposed by being repelled to the fixed electrode 2 when a charge having the same polarity as the charge held by the fixed electrode 2 is applied. On the other hand, the diaphragm 1 is displaced in a direction (second direction) in which the fixed electrode 2 is disposed by being attracted to the fixed electrode 2 when a charge having a polarity opposite to the charge held by the fixed electrode 2 is applied.

The electrostatic force acting between the diaphragm 1 and the fixed electrode 2 is inversely proportional to a square of the distance between the diaphragm 1 and the fixed electrode 2. Therefore, in the single driven electrostatic electroacoustic transducer illustrated in FIG. 1, when the diaphragm 1 is displaced in the first direction, the electrostatic force becomes weaker as the diaphragm 1 moves away from the fixed electrode 2. On the other hand, when the diaphragm 1 is displaced in the second direction, the electrostatic force becomes stronger as the diaphragm 1 approaches the fixed electrode 2. That is, the amount of displacement of the diaphragm 1 in the first direction is smaller than the amount of displacement of the diaphragm 1 in the second direction (a difference in the amount of displacement of the diaphragm 1 is caused). That is, the displacement (vibration) of the diaphragm 1 in the first direction and the second direction is in an unbalanced state. Thus, when the displacement of the diaphragm 1 is in the unbalanced state, the second harmonic (second order distortion) strongly appears in the output (sound wave) of the electrostatic electroacoustic transducer.

On the other hand, in the push-pull driven electrostatic electroacoustic transducer illustrated in FIG. 2, since the fixed electrodes 2 are disposed on both surfaces of the diaphragm 1, no difference in the amount of displacement of the diaphragm 1 is caused. Therefore, the distortion appearing in the single driven electrostatic electroacoustic transducer does not occur. Therefore, the push-pull driven electrostatic electroacoustic transducer is frequently used as an electrostatic electroacoustic transducer used for a speaker and the like.

However, in the push-pull driven electrostatic electroacoustic transducer, the fixed electrodes 2 are also disposed at a position where the diaphragm 1 faces a surface that emits sound waves. Therefore, the sound waves emitted from the diaphragm 1 pass through the openings 2*a* of the fixed electrodes 2. As a result, the frequency response in a high frequency range degraded. Therefore, the sound quality of the push-pull driven electrostatic electroacoustic transducer tends to deteriorate, and an audible volume also tends to decrease, as compared with the single driven electrostatic electroacoustic transducer in which sound waves are emitted without passing through the opening 2*a* of the fixed electrode 2.

To solve such a problem, twin single driven electrostatic electroacoustic transducer having both advantages of the single driven electrostatic electroacoustic transducer and the push-pull driven electrostatic electroacoustic transducer has been proposed (e.g., see Japanese Unexamined Utility Model Application Publication No. S51-44920).

The electrostatic electroacoustic transducer disclosed in Japanese Unexamined Utility Model Application Publication No. S51-44920 includes two diaphragms, a fixed electrode, and two spacers. Each of the two diaphragms is disposed to face both surfaces of the fixed electrode through a spacer. That is, the electrostatic electroacoustic transducer has a structure such that two single driven electrostatic electroacoustic transducers are disposed back-to-back. Each of the two diaphragms includes an electret film. The fixed electrode has electret films on its both sides. When a signal voltage is applied to both diaphragms, the diaphragms are driven to vibrate in the same direction in a state of being acoustically coupled through the fixed electrode disposed between the diaphragms. Therefore, the distortion (second order distortion) generated in the single driven electrostatic electroacoustic transducer hardly occurs in the electrostatic electroacoustic transducer.

However, the structure of the electrostatic electroacoustic transducer disclosed in Japanese Unexamined Utility Model Application Publication No. S51-44920 is complicated as compared with the single driven electrostatic electroacoustic transducer illustrated in FIG. 1. The electrostatic electroacoustic transducer also requires a large number of electret films. Therefore, the manufacturing cost of the electrostatic electroacoustic transducer increases.

Further, a space between one of the diaphragms and the fixed electrode communicates with a space between the other diaphragm and the fixed electrode through a plurality of openings of the fixed electrode. That is, both diaphragms vibrate air in a common closed space. Therefore, the vibration of one of the diaphragms affects the vibration of the other diaphragm. As a result, the distortion (second order distortion) is not sufficiently solved in the electrostatic electroacoustic transducer disclosed in Japanese Unexamined Utility Model Application Publication No. S51-44920.

SUMMARY OF INVENTION

Technical Problem

As described above, there is no fixed electrode on a propagation path of the sound waves in the single driven electrostatic electroacoustic transducer. Therefore, the degradation of frequency response in the high frequency range, the deterioration of sound quality, and lowering of an audible sound volume are less as compared with the push-pull driven electrostatic electroacoustic transducer. Especially, the single driven electrostatic electroacoustic transducer can realize good reproduced sound quality when an amplitude of the diaphragm is small (when the sound pressure emitted by the diaphragm is low). However, as described above, in the single driven electrostatic electroacoustic transducer, when the amplitude of the diaphragm is large (when the sound pressure emitted by the diaphragm is high), a distortion (second order distortion) affecting the reproduced sound quality occurs.

An object of the present invention is to suppress a distortion of a sound wave caused by an unbalanced vibration of a diaphragm in an electrostatic electroacoustic transducer.

Solution to Problem

A signal processing circuit for an electrostatic electroacoustic transducer according to the present invention is configured to correct signals input to a single driven electrostatic electroacoustic transducer including a diaphragm and a fixed electrode disposed to face the diaphragm. The signal processing circuit includes a correction value determiner configured to determine a correction value based on a level of input signal from a sound source, and a level corrector configured to correct the level of the input signal based on the correction value. The level corrector is configured to correct the level of the input signal displacing the diaphragm to a first direction side on which the fixed electrode is not disposed with respect to a predetermined position, among the signals based on the correction value.

Advantageous Effects of Invention

According to the present invention, in an electrostatic electroacoustic transducer, a distortion of a sound wave caused by an unbalanced vibration of a diaphragm can be suppressed.

DESCRIPTION OF EMBODIMENTS

Embodiments of an electrostatic electroacoustic transducer device, a signal processing circuit for an electrostatic electroacoustic transducer, a signal processing method, and a signal processing program according to the present invention will be described with reference to the attached drawings.

Electrostatic Electroacoustic Transducer Device

An embodiment of the electrostatic electroacoustic transducer device according to the present invention (hereinafter referred to as "present device") will now be described.

Configuration of Electrostatic Electroacoustic Transducer Device

Figure 1:
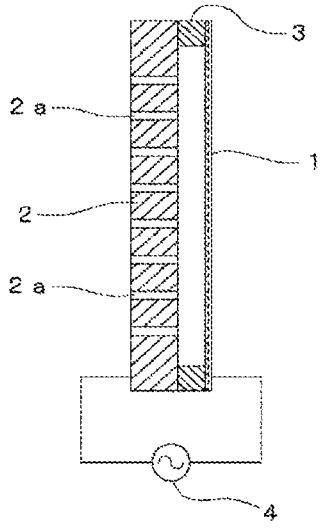
FIG. 1 is a schematic cross-sectional view illustrating a basic configuration of a conventional single driven electrostatic electroacoustic transducer.
Figure 2:
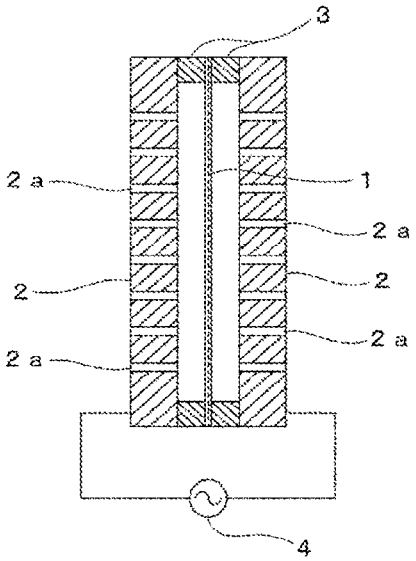
FIG. 2 is a schematic cross-sectional view illustrating a basic configuration of a conventional push-pull driven electrostatic electroacoustic transducer.
Figure 3:
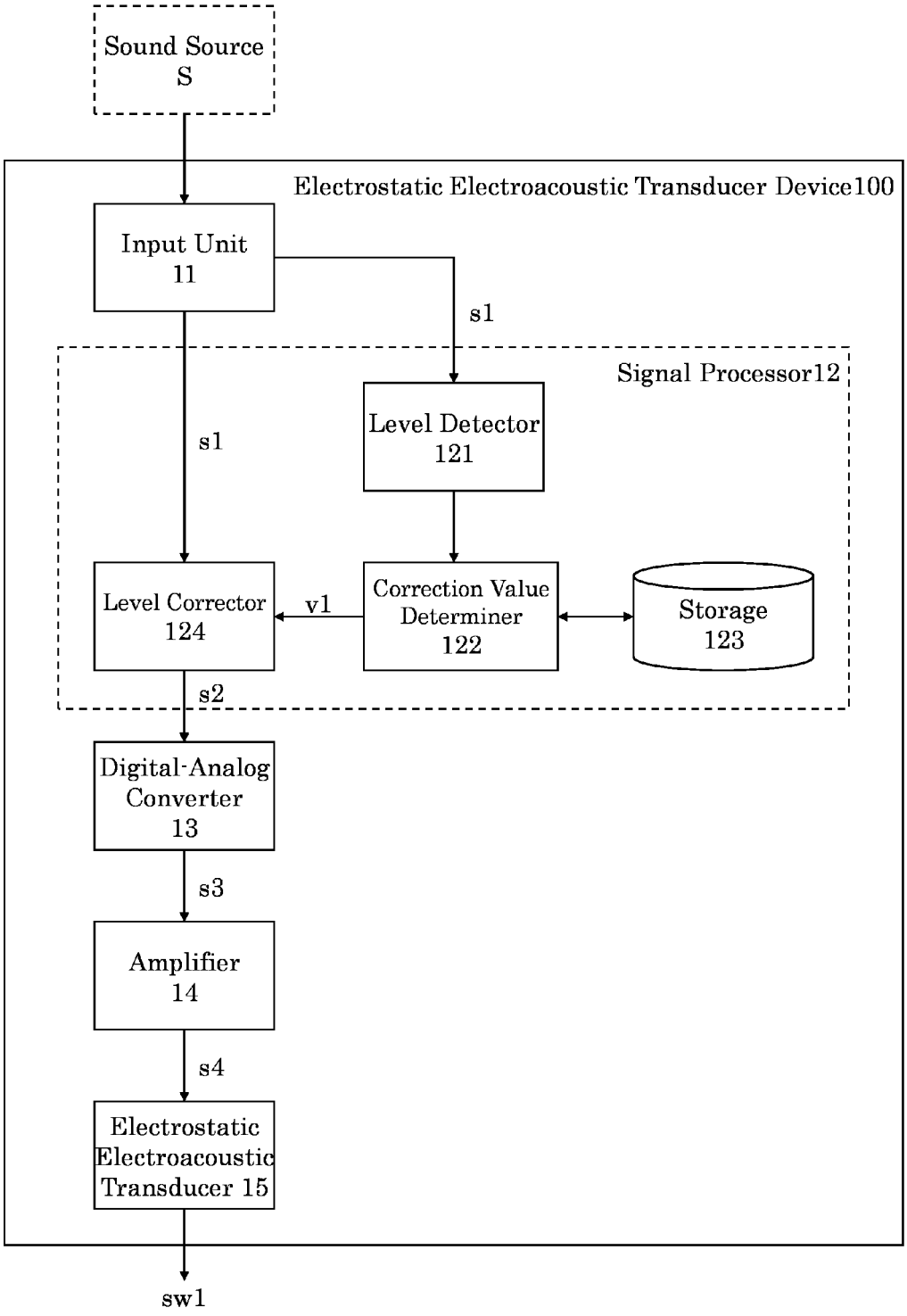
FIG. 3 is a functional block diagram illustrating an embodiment of an electrostatic electroacoustic transducer device according to the present invention.

FIG. 3 is a functional block diagram illustrating an embodiment of the present device.

The present device 100 is configured to convert an electrical signal transmitted from a sound source S such as a smartphone and a portable music reproduction machine to a vibration of air (sound wave) and to output the vibration (sound wave). The present device 100 is, for example, a wired electrostatic headphone to which the electric signal transmitted from the sound source S is inputted via a USB (Universal Serial Bus) cable.

The present device 100 includes an input unit 11, a signal processor 12, a digital-analog converter 13, an amplifier 14, an electrostatic electroacoustic transducer (hereinafter referred to as "headphone unit") 15.

The input unit 11 is an input terminal to which the electrical signal (digital audio signal) transmitted from the sound source S is input. The input unit 11 is, for example, a USB terminal. The input unit 11 is configured to output the electrical signal transmitted from the sound source S as an input signal s1, and to input the input signal to the signal processor 12.

The signal processor 12 is configured to correct a level of the input signal s1 based on the level of the input signal s1 from the input unit 11. The signal processor 12 is configured to output an input signal s2 whose level has been corrected (hereinafter referred to as "corrected signal") to a digital-analog converter 13 in a subsequent step. The signal processor 12 is a signal processing circuit (hereinafter referred to as "present circuit") for the electrostatic electroacoustic transducer according to the present invention. A specific configuration and a specific operation of the signal processor 12 will be described below.

The signal processing program (hereinafter referred to as "present program") according to the present invention realizes the signal processing method according to the present invention in cooperation with the signal processor 12. That is, the present program causes the signal processor 12 to function as the present circuit.

The signal processor 12 includes a level detector 121, a correction value determiner 122, a storage 123, and a level corrector 124.

The level detector 121 is configured to detect the level of the input signal s1 from the input unit 11. The "input signal s1" is a digital audio signal transmitted from the sound source S in units of blocks (frames) of data of a predetermined size. A specific operation of the level detector 121 will be described below.

The correction value determiner 122 is configured to determine a correction value v1 based on the level of the input signal s1 detected by the level detector 121. A specific operation of the correction value determiner 122 will be described below.

The "correction value v1" is a value used to correct the level of the input signal s1. That is, the correction value v1 is a value used in the arithmetic processing for the input signal s1 to displace the below-described diaphragm 151 by a required amount of displacement in the first direction. The first direction and the required amount of displacement will be described below.

The storage 123 is configured to store information necessary for the signal processor 12 to execute the below-described signal processing. The storage 123 is, for example, a semiconductor memory such as a read only memory (ROM) and a random access memory (RAM). The storage 123 stores the below-described parameter Pr or a calculation function in advance.

The level corrector 124 is configured to correct the level of the input signal s1 based on the correction value v1 and to output the corrected signal s2. The corrected signal s2 is a digital signal. A specific operation of the level corrector 124 will be described below.

The level detector 121, the correction-value determiner 122, and the level corrector 124 are configured by, for example, a processor such as a digital signal processor (DSP) and a central processing unit (CPU).

Note that the level detector, the correction value determiner, and the level corrector may not be configured by a common processor. That is, for example, each of the level detector, the correction value determiner, and the level corrector may be configured by a separate processor, or may be configured by a separate circuit that executes a predetermined process.

The digital-to-analog converter 13 is configured to convert the corrected signal s2 output from the signal processor 12 to an analog signal (hereinafter referred to as "analog corrected signal") s3 and to output the analog corrected signal s3. The digital-to-analog converter 13 is, for example, a D/A conversion circuit for converting a digital signal to an analog signal. The analog corrected signal s3 is input to the amplifier 14.

The amplifier 14 is configured to amplify and output the analog corrected signal s3 input from the digital-to-analog converter 13. The amplified analog corrected signal (hereinafter referred to as "amplification-corrected signal") s4 is input to the headphone unit 15.

The headphone unit 15 is configured to convert the input amplification-corrected signal s4 to a vibration of air (sound) to emit a sound wave sw1.

Figure 4:
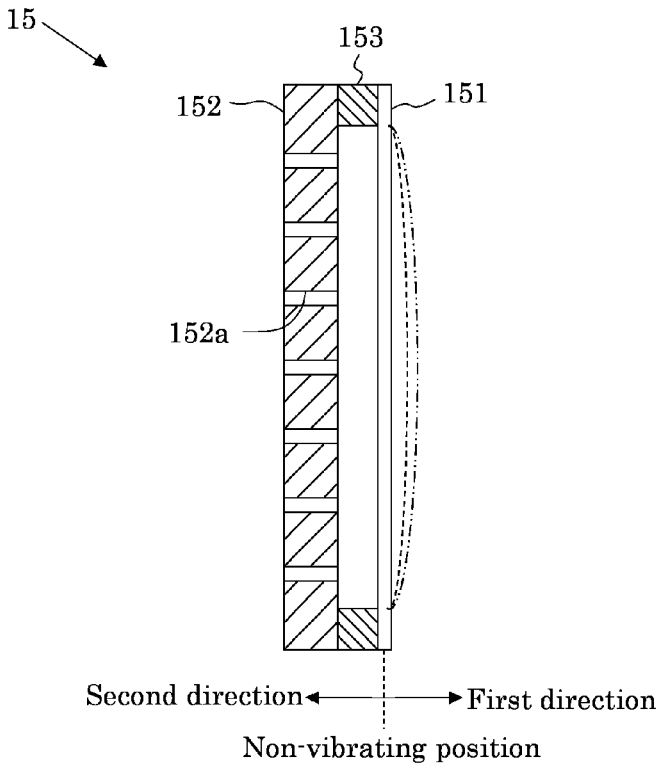
FIG. 4 is a schematic cross-sectional view of an electrostatic electroacoustic transducer provided in the electrostatic electroacoustic transducer device in FIG. 3.

FIG. 4 is a schematic cross-sectional view of the headphone unit 15.

The headphone unit 15 includes a diaphragm 151, a fixed electrode 152, and a spacer 153.

The diaphragm 151 is configured to vibrate in response to the input signal (the amplification-corrected signal s4). The fixed electrode 152 is disposed to face a surface of the diaphragm 151 through the spacer 153 and constitutes a condenser with the diaphragm 151. The fixed electrode 152 includes a plurality of sound holes 152*a* and an electret film (not illustrated). That is, the headphone unit 15 is a single driven headphone unit of an electret type.

Vibration (Displacement) of Diaphragm

When the diaphragm 151 does not vibrate, the diaphragm 151 is at rest at a position (hereinafter referred to as a "non-vibrating position") spaced apart from the fixed electrode 152 by a predetermined interval. The predetermined interval substantially corresponds to the thickness of the spacer 153. When the diaphragm 151 vibrates, the diaphragm 151 is displaced alternately in the first direction and second direction by being repelled or attracted to the fixed electrode 152. The "first direction" is a direction in which the fixed electrode 152 is not disposed with respect to the diaphragm 151. The "second direction" is a direction in which the fixed electrode 152 is disposed with respect to the diaphragm 151.

When the diaphragm 151 is displaced in the first direction in the headphone unit 15 in a state of no level correction by the signal processor 12, the electrostatic force acting between the diaphragm 151 and the fixed electrode 152 becomes weaker in proportion to a square of the relative distance of the diaphragm 151 to the fixed electrode 152. Therefore, the amount of displacement of the diaphragm 151 in the first direction is smaller than the amount of displacement of the diaphragm 151 in the second direction (a difference in the amount of displacement of the diaphragm 151 occurs). That is, at a position where the amount of displacement in the first direction of the diaphragm 151 is the maximum, the amount of displacement of the diaphragm 151 (e.g., a broken line in FIG. 4) is smaller than the required amount of displacement (e.g., a two-dot chain line in FIG. 4). As a result, the vibration of the diaphragm 151 becomes an unbalanced state in the first direction and the second direction in accordance with the distance (the amplitude of the diaphragm 151) between the diaphragm 151 and the fixed electrode 152. The "required displacement amount" is an amount (amplitude) that the diaphragm 151 should be displaced to emit (output) the sound wave corresponding to the input signal s1 from the sound source S.

Thus, when the displacement of the diaphragm 151 is distorted only in one direction (becomes unbalanced), the second harmonic (second order distortion) appears strongly in the output (sound wave) of the headphone unit 15. As a result, the waveform of the output (sound wave) of the headphone unit 15 is nonlinearly distorted as compared with the waveform of the signal (an input signal converted to an analog signal and amplified: amplified input signal) input to the headphone unit 15.

Figure 5:
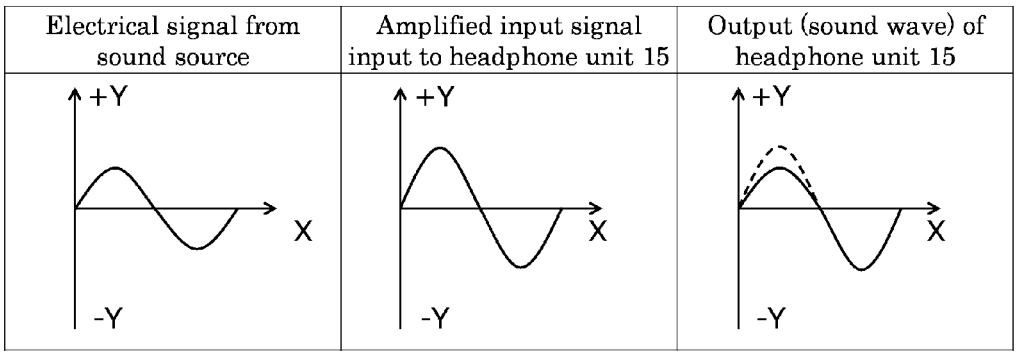
FIG. 5 is a schematic view illustrating an example of distortion of vibration of a diaphragm provided in the electrostatic electroacoustic transducer in FIG. 4.

FIG. 5 is a schematic diagram illustrating an example of the aforementioned distortion.

For convenience of explanation, FIG. 5 illustrates each waveform of the electrical signal transmitted from the sound source S, the amplified input signal, and the output signal (sound wave) in a sine wave shape. In FIG. 5, the Y-axis indicates the level (amplitude) of each signal, and the X-axis indicates time. In the positive direction of the Y-axis, the diaphragm 151 is displaced to the first direction side with respect to the non-vibrating position. On the other hand, in the negative direction of the Y-axis, the diaphragm 151 is displaced to the second direction side with respect to the non-vibrating position.

As illustrated in FIG. 5, the output (sound wave) from the headphone unit 15 in a state of no level correction is attenuated as illustrated with the solid line in FIG. 5, as compared with a case where the diaphragm 151 is displaced by the required amount of displacement in the first direction (as illustrated with the broken line in FIG. 5). The object of the present invention is to suppress the distortion of the output sound wave by suppressing this attenuation.

Operation of Signal Processor (1)

The operation of the signal processor 12 will now be described with reference to FIGS. 3 and 4. The operation of the signal processor 12 will be described with an example in which the storage 123 stores a plurality of parameters Prn (n is an integer) (see FIG. 7). In the present embodiment, when it is not necessary to distinguish each parameter Prn, each is collectively referred to as a "parameter Pr". As an example, in the following description, the parameter Pr is used as the correction value v1 to be added to the input signal s1.

The "parameter Pr" is information for increasing the level of the input signal s1 according to the level of the input signal s1. In the present embodiment, the parameter Pr is an added value to be added to the input signal s1 as the correction value v1. The parameter Pr is calculated as a value for correcting the amount of displacement of the diaphragm 151 in the first direction to suppress the unbalance displacement of the diaphragm 151. That is, for example, the parameter Pr is calculated based on the degree of amplification of the level calculated based on the measured value. The parameter Pr is preset for each electrostatic electroacoustic transducer according to the level of the input signal s1. The parameter Pr is stored in the storage 123 in association with the level of the input signal s1, for example, as a look-up table T (see FIG. 7).

Figure 6:
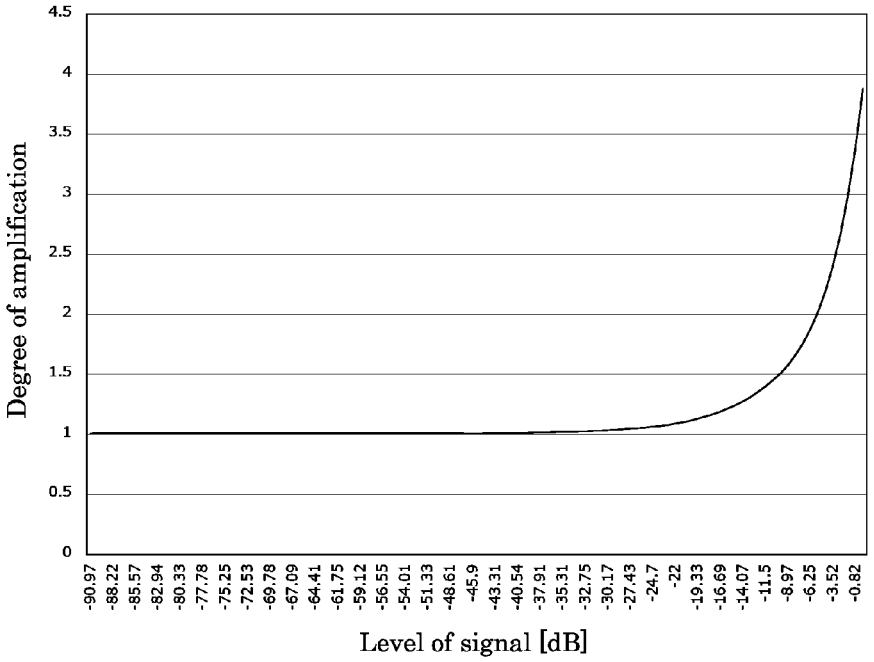
FIG. 6 is a graph showing a relationship between a level of a signal input to the electrostatic electroacoustic transducer in FIG. 4 and a degree of amplification required for the level.

FIG. 6 is a graph showing the relationship between the level of the signal input to the headphone unit 15 and the degree of amplification required to suppress the distortion of vibration of the diaphragm 151 with respect to the level.

As shown in FIG. 6, an amplification up to a certain level is constant at approximately "1", and an amplification increases exponentially above the certain level.

Figure 7:
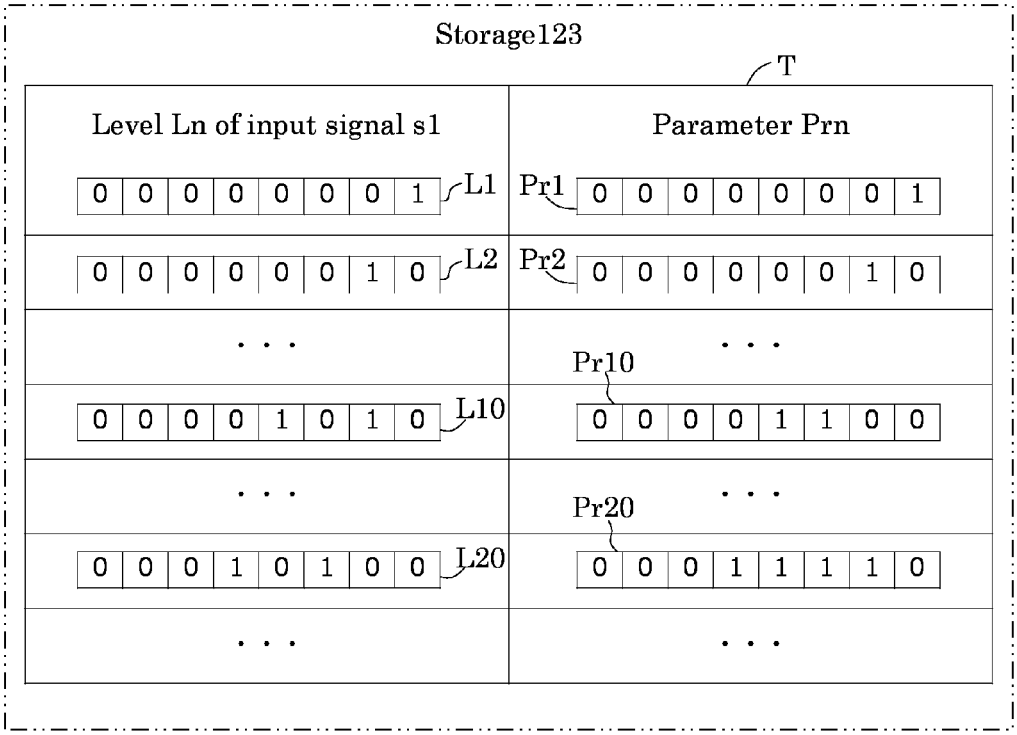
FIG. 7 is a schematic diagram illustrating an example of information stored in a storage provided in the electrostatic electroacoustic transducer device in FIG. 3.

FIG. 7 is a schematic diagram illustrating an example of a parameter Pr stored in the storage 123.

FIG. 7 illustrates that a level Ln (n is an integer) of the input signal s1 and the parameter Prn corresponding to the level Ln are stored in the storage 123 as a correspondence table corresponding one-to-one. That is, in FIG. 7, each parameter Prn (n is an integer) is stored in association with the level Ln of the input signal s1. For convenience of explanation, FIG. 7 illustrates the level Ln of the input signal s1 and the parameter Prn in binary 8-bit. In the FIG. 7, the most significant bit of the level Ln of the input signal s1 (left end bit in FIG. 7) represents the positive and negative of the level to be described below. That is, for example, when the most significant bit is "0", the level Ln of the input signal s1 is "positive", and when the most significant bit is "1", the level Ln of the input signal s1 is "negative".

In FIG. 7, the parameter Pr corresponding to the level "L1" of the input signal s1 is "Pr1", and its value is "1" in decimal notation. The parameter Pr corresponding to the level "L10" of the input signal s1 is "Pr10", and its value is "12" in decimal notation. Further, the parameter Pr corresponding to the level "L20" of the input signal s1 is "Pr20", and its value is "30" in decimal notation. Thus, each parameter Pr1-Prn has a value of non-linearity for an increase in each level L1-Ln.

Figure 8:
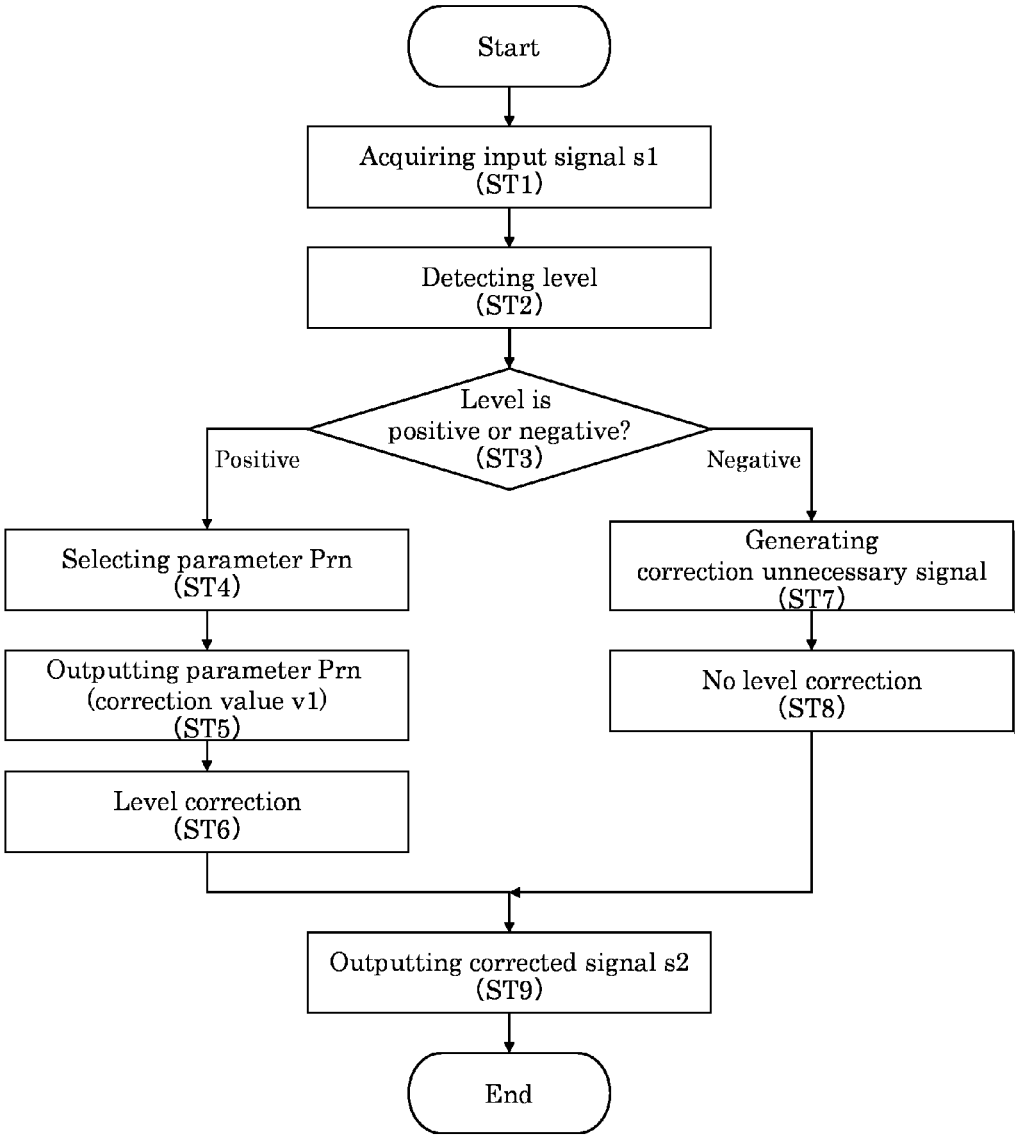
FIG. 8 is a flowchart illustrating an example of an operation of a driving circuit provided in the electrostatic electroacoustic transducer device in FIG. 3.

FIG. 8 is a flowchart illustrating an example of the operation of the signal processor 12.

The level detector 121 acquires the input signal s1 from the input unit 11 (ST1). As described above, the input signal s1 is a digital audio signal.

The level detector 121 then detects the level of the input signal s1 (ST2).

The correction value determiner 122 then determines whether the level of the input signal s1 is positive or negative based on the level of the input signal s1 detected by the level detector 121 (ST3).

The "positive and negative of the level" is a sign indicating the direction of displacement of the diaphragm 151. In the present embodiment, the "positive" level indicates a voltage for displacing the diaphragm 151 to the first direction side (the direction side on which the fixed electrode 152 is not disposed) with respect to the non-vibrating position. The level of "negative" indicates a voltage for displacing the diaphragm 151 to the second direction side (the direction side on which the fixed electrode 152 is disposed) with respect to the non-vibrating position.

When the level of the input signal s1 is "positive" ("positive" in ST3), the correction value determiner 122 selects a parameter Prn corresponding to the level Ln of the input signal s1 by referring to the look-up table T stored in the storage 123 (ST4). That is, the correction value determiner 122 selects a parameter Prn from the plurality of parameter Pr1-Prn based on the level of the input signal s1 detected by the level detector 121.

The correction value determiner 122 then outputs the selected parameter Prn as the correction value v1 to the level corrector 124 (ST5). That is, the correction value determiner 122 determines the selected parameter Prn as the correction value v1 based on the level of the input signal s1.

The level corrector 124 then corrects the level of the input signal s1 based on the correction value v1 output from the correction value determiner 122 (ST6). In the present embodiment, the level corrector 124 adds the correction value v1 to the input signal s1. That is, the level corrector 124 increases a level of the input signal s1 which displaces the diaphragm 151 in the first direction, among the input signals s1.

As described above, the correction value v1 (parameter Pr) has a value of non-linearity with respect to an increase in level. In other words, the level corrector 124 corrects the non-linearity of the level of the input signal s1.

On the other hand, when the level of the input signal s1 is "negative" ("negative" in ST3), the correction value determiner 122 generates, for example, a signal indicating that level correction is unnecessary (hereinafter referred to as "correction unnecessary signal"), and outputs the generated signal to the level corrector 124 (ST7).

Then, the level corrector 124 to which the correction unnecessary signal is input does not correct the level of the input signal s1 (ST8). That is, the level corrector 124 does not correct a level of the input signal s1 which displaces the diaphragm 151 in the second direction, among the input signals s1.

Figure 9:
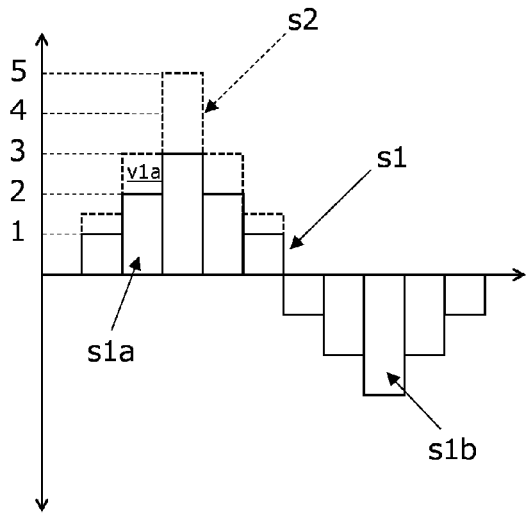
FIG. 9 is a schematic diagram illustrating a concept of level correction by a level corrector provided in the electrostatic electroacoustic transducer device in FIG. 3.

FIG. 9 is a schematic diagram illustrating the concept of level correction of the level corrector 124.

For convenience of explanation, FIG. 9 illustrates the input signal s1 in a sinusoidal shape. In FIG. 9, the vertical axis represents the level of the signal, and the horizontal axis represents time. FIG. 9 illustrates the level of the input signal s1 detected by the level detector 121 with a solid line, and the level after correction (the level of the corrected signal s2) with a broken line. FIG. 9 illustrates that a level of an input signal s1*a* is "2", a correction value v1*a* of the input signal s1*a* is "1", and a level after correction of the input signal s1*a* is "3". Further, FIG. 9 illustrates that a level of an input signal s1*b* is "negative", and the level is not corrected.

Referring now back to FIG. 8, the level corrector 124 then outputs an input signal (corrected signal s2) whose level has been corrected (S9). On the other hand, an input signal s1 whose level is "negative" is output as the corrected signal s2 from the level corrector 124 whose level is not corrected. That is, the corrected signal s2 is the input signal s1 (digital signal) which is corrected by the level corrector 124, or the input signal s1 (digital signal) which is not corrected by the level corrector 124. In this way, the level corrector 124 corrects level only for the input signal s1 whose level is "positive" among the input signals s1. In other words, the level corrector 124 corrects level only for the input signal s1 which displaces the diaphragm 151 to the first direction side with respect to the non-vibrating position, among the input signals s1. That is, the level corrector 124 corrects the level of an input signal s1 (the input signal s1 for displacing the diaphragm 151 to the first direction side with respect to the non-vibrating position) among the input signals s1.

Referring now back to FIG. 3, the corrected signal s2 is converted to an analog signal by the digital-to-analog converter 13 and input to the amplifier 14 as an analog corrected signal s3. The analog corrected signal s3 is amplified by the amplifier 14 and input to the headphone unit 15 as an amplification-corrected signal s4 (analog signal). The diaphragm 151 vibrates in response to the amplification-corrected signal s4 and emits (outputs) the sound wave sw1.

As described above, the level corresponding to only a signal which displaces the diaphragm 151 to the first direction side with respect to the non-vibrating position is corrected (increased), among the input signals s1. Therefore, only the level of the amplification-corrected signal s4 among the amplification-corrected signals s4, which displaces the diaphragm 151 to the first direction side with respect to the non-vibrating position, is increased as compared with a signal whose level is not corrected (hereinafter referred to as "uncorrected signal"). Therefore, the displacement in the first direction of the diaphragm 151 to which the amplification-corrected signal s4 is input is larger than the displacement of the diaphragm 151 when the uncorrected signal is input. That is, the unbalanced vibration of the diaphragm 151 is suppressed. Consequently, the distortion of the output (sound wave sw1) of the headphone unit 15 when the amplification-corrected signal s4 is input is suppressed as compared with the output when the uncorrected signal is input. Thus, in the present device 100, the shortage of the amount of displacement of the diaphragm 151 in the first direction is corrected, and the distortion of the sound wave is suppressed.

Figure 10:
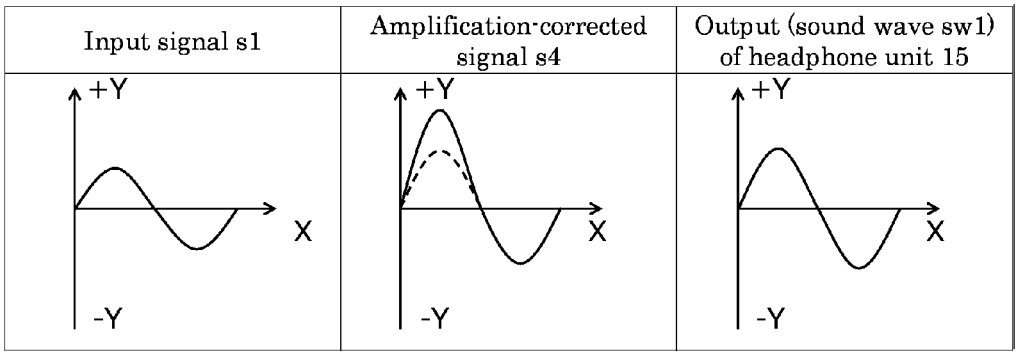
FIG. 10 is a schematic diagram illustrating an example in which the distortion in FIG. 5 is suppressed by the operation of the driving circuit in FIG. 8.

FIG. 10 is a schematic diagram illustrating an example in which unbalanced vibration of the diaphragm 151 is suppressed by the signal processor 12.

For convenience of explanation, FIG. 10 illustrates the waveform of each of the input signal s1, the amplification-corrected signal s4, and an output (sound wave sw1) in a sinusoidal shape. The X-axis and the Y-axis in FIG. 10 are common to those in FIG. 4.

As illustrated in FIG. 10, the level of an amplification-corrected signal s4 which displaces the diaphragm 151 in the first direction (the positive direction of the Y-axis), among the amplification-corrected signals s4 is increased by the correction of the input signal s1 as compared with a case where the correction is not performed (broken line in FIG. 10). The amount of increasing this level is calculated to suppress an unbalanced vibration of the diaphragm 151. Therefore, the unbalanced vibration of the diaphragm 151 is suppressed and the distortion of the sound wave sw1 emitted from the diaphragm 151 is suppressed.

Note that the correction value determiner may not generate the correction unnecessary signal when the level of the input signal is "negative". That is, when the level of the input signal is "negative", the correction value determiner may not output the correction value or the signal to the level corrector. In this configuration, the level corrector may not correct level for a reason of no input of correction value or signal from the correction value determiner to the level corrector.

Further, when the level of the input signal is "negative", the correction value determiner may output a correction value indicating "0" to the level corrector. In this configuration, the level corrector adds "0" to the input signal.

Further, the storage may store one of the parameters corresponding to each range of level of the input signal. In this case, the range of level may be divided equally or unequally in accordance with an increase in level. For example, if the range of level is divided unequally, the range of level may be divided to be narrower inversely proportional to the increase in level. In other words, the range of level may become exponentially narrower as the increase in level. In this configuration, a parameter is set for each range of the level of the input signal, not for each level of the input signal. Therefore, the number of parameters can be reduced more than the number of parameters set for each level. Accordingly, the capacity of the storage can be reduced, and the time required for selecting a parameter can be shortened.

Furthermore, the level corrector may multiply the input signal by a parameter. That is, for example, the parameter may be the amplification value shown in FIG. 6. In this case, the value of the parameter is constant up to a predetermined level and increases exponentially above the predetermined level. Instead, for example, the value of the parameter may be constant for all levels. In this configuration, the level corrector multiplies the input signal by the parameter (correction value) to increase the level of the input signal. In other words, the level corrector controls the gain of the level of an input signal among the input signals. That is, the parameter is a signal (gain control signal) that controls the gain of the level of an input signal among the input signals.

Further, the storage may store a plurality of parameter groups consisting of a plurality of parameters. That is, for example, the storage may store a plurality of parameter groups corresponding to the amount (suppression amount) of suppressing distortion of the sound wave output from the diaphragm. That is, a parameter constituting one parameter group (first parameter group) is different from a parameter constituting another parameter group (second parameter group). Each parameter group may be stored, for example, as a look-up table corresponding to each parameter group. Further, some of the parameters constituting the first parameter group are in common with some of the parameters constituting the second parameter group.

When the second harmonic (second order distortion) of the electrostatic electroacoustic transducer is suppressed, a third harmonic relatively tends to be stronger. Taking advantage of this tendency, the headphone unit 15 can output a sound wave on which the second harmonic and the third harmonic are moderately superimposed. That is, the device 100 stores a plurality of parameter groups corresponding to the superposition state (suppression amount) of the second harmonic and the third harmonic and accordingly, the user of the device 100 can appropriately select one parameter group from the plurality of parameter groups to change the audible sound quality.

Operation of Signal Processor (2)

Another operation (hereinafter referred to as "second operation") of the signal processor 12 will now be described with reference to FIGS. 3 and 4. Hereinafter, the operation of the signal processor 12 will be described with reference to an exemplary case where the storage 123 stores a calculation function. The difference between the second operation and the aforementioned operation (hereinafter referred to as "first operation") of the signal processor 12 is only an operation of the correction value determiner 122. The second operation will be described focusing on a point different from the first operation.

The "calculation function" is a polynomial function approximating a degree of amplification for a level, shown in FIG. 6. That is, the calculation function is the polynomial function approximating a measured value of a parameter (correction value). The "degree of amplification" is a coefficient multiplied by the input signal s1 so as to most suppress the distortion of the sound wave output from the diaphragm 151. The degree of amplification is an example of the correction value in the present invention. That is, in the following description, the amplification degree is used as the correction value v1 to be multiplied by the input signal s1. The degree of amplification for the level differs for each electrostatic electroacoustic transducer. Therefore, the calculation function is determined according to the electrostatic electroacoustic transducer. The calculation function is, for example, a function of an eleventh-order polynomial represented by the following equation 1.

$$\text{Degree of Amplification}=aX^{11}+bX^{10}+cX^{9}+\ldots+jX^{2}+kX+1 \quad \text{(Equation 1)}$$

"X" is the level of the input signal s1, and "a, b, c . . . j, k, l" is a coefficient determined by the polynomial approximation.

Figure 11:
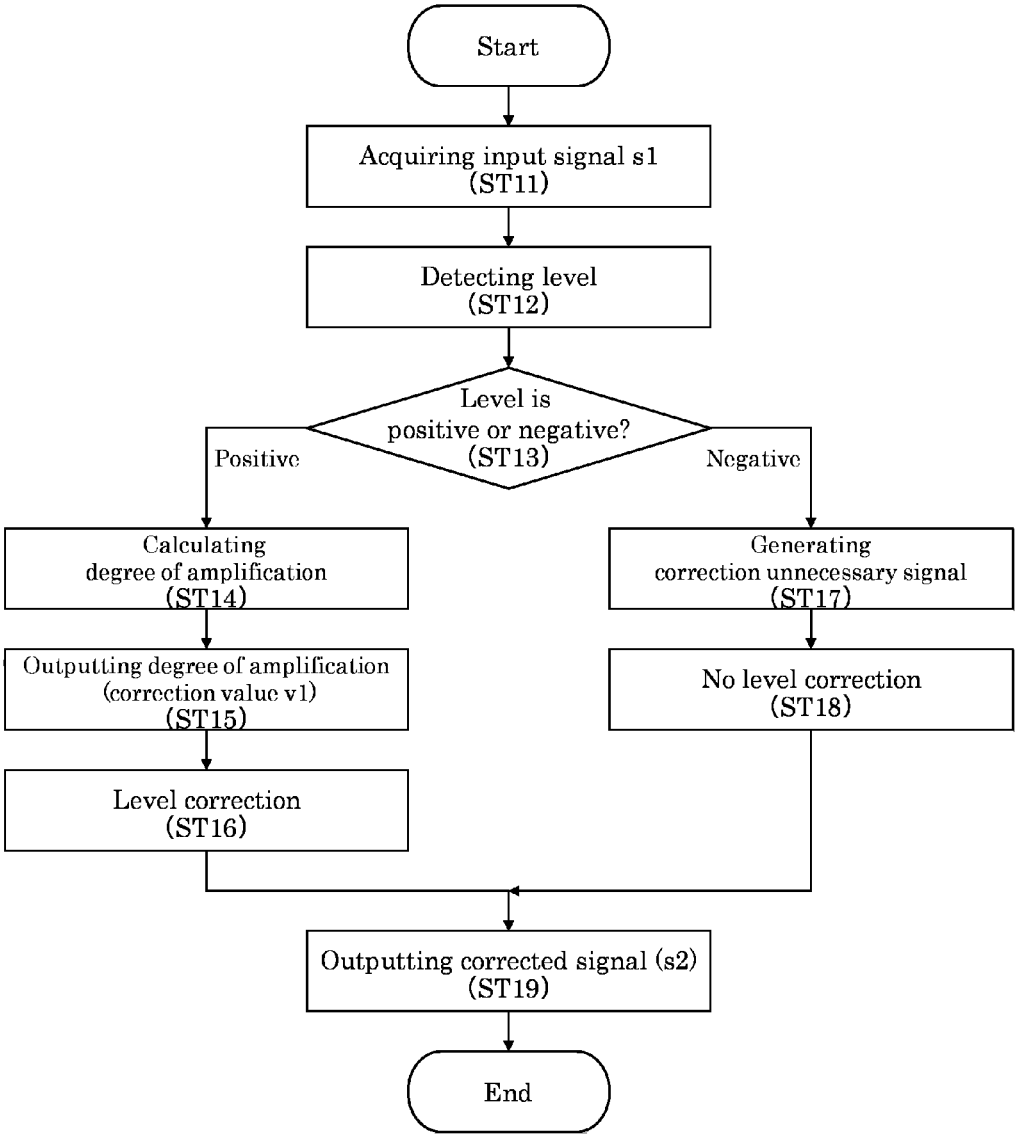
FIG. 11 is a flowchart illustrating another example of an operation of the driving circuit for the electrostatic electroacoustic transducer device in FIG. 3.

FIG. 11 is a flowchart illustrating another example of the operation of the signal processor 12.

In the second operation, processes (ST11-ST13) are the same as the processes of the first operation (ST1-ST3 in FIG. 8).

When the level of the input signal s1 is "positive" ("positive" in ST13), the correction value determiner 122 refers to the calculation function stored in the storage 123 to calculate the degree of amplification corresponding to the level Ln of the input signal s1 (ST14). That is, the correction value determiner 122 calculates the amplification degree based on the level of the input signal s1 detected by the level detector 121 and the calculation function.

The correction value determiner 122 then outputs the calculated degree of amplification as the correction value v1 to the level corrector 124 (ST15).

The level corrector 124 then corrects the level of the input signal s1 based on the correction value v1 output from the correction value determiner 122 (ST16). In the present embodiment, the level corrector 124 multiplies the input signal s1 by the correction value v1. That is, the level corrector 124 corrects the input signal s1 in accordance with a predetermined condition (increases the level of an input signal s1 among the input signals s1).

On the other hand, when the level of the input signal s1 is "negative" ("negative" in ST13), the correction value determiner 122, for example, generates the correction unnecessary signal and outputs the correction unnecessary signal to the level corrector 124 (ST17).

Then, the level corrector 124 to which the correction unnecessary signal is input does not correct the level of the input signal s1 (ST18). That is, the level corrector 124 does not correct the level of an input signal s1 which displaces the diaphragm 151 in the second direction, among the input signals s1.

The level corrector 124 then outputs an input signal (corrected signal s2) whose level has been corrected (S19). On the other hand, an input signal s1 whose level is "negative" is output as the corrected signal s2 from the level corrector 124 whose level is not corrected.

Note that the storage may store a plurality of calculation functions according to an amount for suppressing the unbalanced vibration of the diaphragm (that is, an amount for correcting level). The present device stores a plurality of calculation functions corresponding to the superposition state of the second harmonic and third harmonic, and accordingly the user of the present device can appropriately select one parameter group from the plurality of parameter groups to change the audible sound quality.

Further, when the level of the input signal is "negative", the correction value determiner may not generate the correction unnecessary signal. That is, when the level of the input signal is "negative", the correction value determiner may not output the correction value or signal to the level corrector. In this configuration, the level corrector may not correct level for a reason of no input of correction value or signal from the correction value determiner to the level corrector.

Furthermore, when the level of the input signal is "negative", the correction value determiner may output a correction value indicating "1" to the level corrector. In this configuration, the level corrector multiplies the input signal by "1".

Conclusion

According to the embodiment described above, the level corrector 124 is configured to perform the correction for increasing the level of an input signal s1 among the input signals s1 based on the correction value v1. The input signal s1 corresponds to a signal for displacing the diaphragm 151 to the first direction side with respect to the non-vibrating position. As a result, in the displacement in the first direction, the amount of displacement of the diaphragm 151 is approximated to the amount of displacement necessary to emit the sound wave corresponding to the input signal s1. That is, the unbalanced vibration of the diaphragm 151 is suppressed. As a result, the distortion of the sound wave output from the diaphragm 151 is suppressed.

Further, according to the embodiment described above, the level detector 121 detects the level of the input signal s1. The correction value determiner 122 is configured to determine the correction value v1 based on the level of the input signal s1. Thus, the present device 100 is configured to detect the level of each input signal s1, and to correct the level, by digital signal processing. As a result, the present device 100 is configured to realizes a level correction for the input signal s1 with a good ability of following at a processing speed that cannot be realized by an analog signal processing (e.g., an integration processing per unit time).

Furthermore, according to the embodiment described above, the correction value determiner 122 is configured to select one parameter Pr from the plurality of parameters Pr based on the level detected by the level detector 121, and to output the parameter Pr to the level corrector 124 as the correction value v1. According to this configuration, the correction value determiner 122 does not require an operation to determine the correction value v1, and can determine the correction value v1 in an extremely short time.

Further, according to the embodiment described above, the correction value determiner 122 is configured to calculate the correction value v1 based on the level detected by the level detector 121 and the calculation function. According to this configuration, the correction value determiner 122 can continuously determine the correction value v1 in accordance with variation of level. Further, as compared with the first operation, the storage 123 does not need to store many parameters, and thus the capacity of the storage 123 can be reduced.

Note that the input signal s1 is a digital audio signal in the embodiment described above. Alternatively, the input signal input to the input unit may be an analog audio signal. In this configuration, the present device includes an analog-to-digital conversion circuit between the input unit and the signal processor to perform sampling before input to the signal processor. As a result, the same signal processing as the aforementioned embodiment can be performed.

Further, the present device is not limited to the electrostatic headphone. That is, for example, the present device may be an electrostatic earphone or an electrostatic speaker.

Further, in the embodiment described above, the electrostatic electroacoustic transducer device (the present device 100) is provided with the present circuit (the signal processor 12). Alternatively, the circuit may be provided with a sound source (e.g., a smartphone or portable music player). That is, for example, a corrected signal may be generated in the sound source and transmitted to the electrostatic electroacoustic transducer device, such as a headphone. In this configuration, the sound source may acquire a parameter or a calculation function corresponding to the electrostatic electroacoustic transducer device via a communication line such as the Internet. The aforementioned parameter group and calculation function may be changed by the user through operating the sound source.

Furthermore, the present device may be connected to a sound source via a wireless communication network such as Bluetooth (registered trademark). In this case, the device includes a communication unit for wireless communication.

Furthermore, the aforementioned signal processing is also applicable when the level of the input signal is "negative". That is, for example, the correction value determiner determines a correction value for decreasing the level of the input signal. The level corrector performs correction to reduce level of an input signal which corresponds to a signal for displacing the diaphragm to the second direction side with respect to the non-vibrating position, among the input signals. In this configuration, the level corrector may add a correction value to be a negative value to the input signal, may subtract a correction value to be a positive value from the input signal, or may be multiply a correction value to be a value less than 1 by the input signal.

Further, the means for realizing the present method is not limited to the present program.

Summary of Electrostatic Electroacoustic Transducer Device, Signal Processing Circuit, Signal Correction Method and Signal Correction Program Configurational features of the electrostatic electroacoustic transducer device, the signal processing circuit for the electrostatic electroacoustic transducer, the signal processing method, and the signal processing program according to the present invention described above will be summarized below.

(Feature 1)

A signal processing circuit for an electrostatic electroacoustic transducer configured to correct signals input to a single driven electrostatic electroacoustic transducer (e.g., a headphone unit 15) including a diaphragm (e.g., a diaphragm 151) and a fixed electrode (e.g., a fixed electrode 152) disposed to face the diaphragm, the signal processing circuit comprising:

a correction value determiner (e.g., a correction value determiner 122) configured to determine a correction value based on a level of an input signal (e.g., input signal s1) from a sound source; and a level corrector (e.g., a level corrector 124) configured to correct the level of the input signal based on the correction value, wherein the level corrector is configured to correct the level of the input signal displacing the diaphragm to a first direction side on which the fixed electrode is not disposed with respect to a predetermined position (e.g., a non-vibrating position), among the signals based on the correction value.

(Feature 2)

The signal processing circuit for the electrostatic electroacoustic transducer according to feature 1, wherein the level corrector is configured to increase the level.

(Feature 3)

The signal processing circuit for the electrostatic electroacoustic transducer according to feature 1, wherein the correction value is a value for displacing the diaphragm by a required amount of displacement in the first direction.

(Feature 4)

The signal processing circuit for the electrostatic electroacoustic transducer according to feature 1, further comprising:

a level detector (e.g., a level detector 121) configured to correct the level of the input signal, wherein the correction value determiner is configured to determine the correction value based on the level detected by the level detector.

(Feature 5)

The signal processing circuit for the electrostatic electroacoustic transducer according to feature 4, further comprising:

a storage (e.g., a storage 123) configured to store a plurality of parameters (e.g., parameter Pr) corresponding to the plurality of levels of the signals, wherein the correction value determiner is configured to select a parameter from the plurality of parameters based on the level detected by the level detector and to output the selected parameter as the correction value to the level corrector.

(Feature 6)

The signal processing circuit for the electrostatic electroacoustic transducer of feature 5, wherein the storage is configured to store one of the parameters corresponding to each range of the level.

(Feature 7)

The signal processing circuit for the electrostatic electroacoustic transducer according to feature 5, wherein the storage is configured to store parameter groups composed of a plurality of parameters, the parameter groups include a first parameter group and a second parameter group, and a plurality of parameters constituting the first parameter group are different from a plurality of parameters constituting the second parameter group.

(Feature 8)

The signal processing circuit for the electrostatic electroacoustic transducer according to feature 4, wherein the correction value determiner is configured to calculate the correction value based on the level detected by the level detector.

(Feature 9)

The signal processing circuit for the electrostatic electroacoustic transducer according to feature 8, further comprising:

a storage configured to store a calculation function determined in accordance with the electrostatic electroacoustic transducer, wherein the correction value determiner is configured to calculate the correction value based on the calculation function.

(Feature 10)

The signal processing circuit for the electrostatic electroacoustic transducer according to feature 9, wherein the calculation function is a polynomial approximating a measured value of the correction value, and the correction value determiner is configured to calculate the correction value using the polynomial.

(Feature 11)

The signal processing circuit for the electrostatic electroacoustic transducer according to feature 9, wherein the storage is configured to store a plurality of calculation functions corresponding to an amount for correcting the level.

(Feature 12)

The signal processing circuit for the electrostatic electroacoustic transducer according to feature 1, wherein the level corrector is configured to correct a non-linearity of the level.

(Feature 13)

An electrostatic electroacoustic transducer device (e.g., an electrostatic electroacoustic transducer device 100) comprising:

a single driven electrostatic electroacoustic transducer including a diaphragm and a fixed electrode disposed to face the diaphragm; and a signal processing circuit configured to correct signals input to the electrostatic electroacoustic transducer, wherein the signal processing circuit is a signal processing circuit for the electrostatic electroacoustic transducer of feature 1.

(Feature 14)

A signal processing method executed by a signal processing circuit configured to correct signals input to a single driven electrostatic electroacoustic transducer comprising a diaphragm and a fixed electrode disposed to face the diaphragm, the signal processing method including:

determining (e.g., processing (ST4 and ST14)) a correction value based on a level of an input signal from a sound source; and correcting (e.g., processing (ST6 and ST16)) the level of the input signal based on the correction value, wherein correcting corrects the level of the input signal displacing the diaphragm to a first direction side on which the fixed electrode is not disposed with respect to a predetermined position, among the signals.

(Feature 15)

A signal processing program executed by a signal processing circuit configured to correct signals input to a single driven electrostatic electroacoustic transducer comprising a diaphragm and a fixed electrode disposed to face the diaphragm, the signal processing program causing the signal processing circuit to function as a signal processing circuit for an electrostatic electroacoustic transducer of feature 1.

(Feature 16)

A driving circuit (e.g., a signal processor 12, a digital-to-analog converter 13) for an electrostatic electroacoustic transducer configured to supply a drive signal (e.g., a corrected signal s2) to a single driven electrostatic electroacoustic transducer (e.g., headphone unit 15) provided with a fixed electrode disposed on one side of a diaphragm 151 (e.g., a fixed electrode 152), the driving circuit comprising:

a gain control signal generator (e.g., a correction value determiner 122) configured to generate a gain control signal in accordance with a level of an input signal (e.g., input signal s1); and a level controller (e.g., a level corrector 124) configured to control the level of the input signal in response to receiving the gain control signal from the gain control signal generator, wherein the level controller is configured to perform nonlinear waveform correction for the input signal by which the diaphragm is separated from the fixed electrode by a predetermined distance or more based on the gain control signal from the gain control signal generator, and an output from the level collector is served as the drive signal to be added to the single driven electrostatic electroacoustic transducer.

(Feature 17)

The driving circuit for the electrostatic electroacoustic transducer according to feature 16, wherein the level controller is configured to perform waveform correction for enlarging a level of an output signal (e.g., a corrected signal s2) for the input signal by which the diaphragm is separated from the fixed electrode by a predetermined distance or more based on the gain control signal from the gain control signal generator.

(Feature 18)

The driving circuit for the electrostatic electroacoustic transducer according to feature 16, wherein the gain control signal generator includes:

a level detector (e.g., a level detector 121) configured to detect a level of an input signal (e.g., an input signal s1) per sampling; and a plurality of the look-up tables (e.g., a look-up table T) in which a parameter (e.g., a parameter Pr) corresponding to the level of the input signal is stored, and the gain control signal generator is configured to read out the parameter corresponding to the level detection value of the input signal detected by the level detector from the look-up tables, and provides the read-out parameter to the level controller as the gain control signal.

(Feature 19)

The driving circuit for the electrostatic electroacoustic transducer according to feature 18, wherein a plurality of look-up tables having different parameters corresponding to the level of the input signal are provided, and the plurality of look-up tables are configured to be selectable.

(Feature 20)

The driving circuit for the electrostatic electroacoustic transducer according to feature 16, wherein the gain control signal generator includes:

a level detector configured to detect the level of the input signal per sampling; and a gain control signal calculator (e.g., a correction value determiner 122) configured to calculate a gain control signal corresponding to the level of the input signal in accordance with a predetermined calculation function, and a gain control signal calculated by the gain control signal calculator based on a level detection value of the input signal detected by the level detector is provided to the level controller.

(Feature 21)

The driving circuit for the electrostatic electroacoustic transducer according to feature 20, wherein the calculation function used in the gain control signal calculator is configured to be rewritable.

(Feature 22)

The driving circuit for the electrostatic electroacoustic transducer according to feature 20, wherein the gain control signal calculator is configure to approximate a measured value of a gain control signal by which a secondary distortion for a level of an input signal generated depending on a distance between the diaphragm and the fixed electrode is suppressed by a polynomial, and to calculate a gain control signal corresponding to the level of the input signal detected by the level detector using the polynomial.

(Feature 23)

The driving circuit for the electrostatic electroacoustic transducer according to feature 22, wherein the calculation function is rewritten by selecting a coefficient of the polynomial.

The invention claimed is:

1. A signal processing circuit for an electrostatic electroacoustic transducer configured to correct signals input to a single driven electrostatic electroacoustic transducer including a diaphragm and a fixed electrode disposed to face the diaphragm, the signal processing circuit comprising:

a correction value determiner configured to determine a correction value based on a level of an input signal from a sound source; and a level corrector configured to correct the level of the input signal based on the correction value, wherein the level corrector is configured to correct the level of the input signal displacing the diaphragm to a first direction side on which the fixed electrode is not disposed with respect to a predetermined position, among the signals based on the correction value.

2. The signal processing circuit for the electrostatic electroacoustic transducer according to claim 1, wherein the level corrector is configured to increase the level.

3. The signal processing circuit for the electrostatic electroacoustic transducer according to claim 1, wherein the correction value is a value for displacing the diaphragm by a required amount of displacement in the first direction.

4. The signal processing circuit for the electrostatic electroacoustic transducer according to claim 1, further comprising:

a level detector configured to correct the level of the input signal, wherein the correction value determiner is configured to determine the correction value based on the level detected by the level detector.

5. The signal processing circuit for the electrostatic electroacoustic transducer according to claim 4, further comprising:

a storage configured to store a plurality of parameters corresponding to a plurality of levels of the signals, wherein the correction value determiner is configured to select a parameter from the plurality of parameters based on the level detected by the level detector and to output the selected parameter as the correction value to the level corrector.

6. The signal processing circuit for the electrostatic electroacoustic transducer according to claim 5, wherein the storage is configured to store one of the parameters corresponding to each range of the level.

7. The signal processing circuit for the electrostatic electroacoustic transducer according to claim 5, wherein the storage is configured to store parameter groups composed of a plurality of parameters, the parameter groups include a first parameter group and a second parameter group, and a plurality of parameters constituting the first parameter group are different from a plurality of parameters constituting the second parameter group.

8. The signal processing circuit for the electrostatic electroacoustic transducer according to claim 4, wherein the correction value determiner is configured to calculate the correction value based on the level detected by the level detector.

9. The signal processing circuit for the electrostatic electroacoustic transducer according to claim 8, further comprising:

a storage configured to store a calculation function determined in accordance with the electrostatic electroacoustic transducer, wherein the correction value determiner is configured to calculate the correction value based on the calculation function.

10. The signal processing circuit for the electrostatic electroacoustic transducer according to claim 9, wherein the calculation function is a polynomial approximating a measured value of the correction value, and the correction value determiner is configured to calculate the correction value using the polynomial.

11. The signal processing circuit for the electrostatic electroacoustic transducer according to claim 9, wherein the storage is configured to store a plurality of calculation functions corresponding to an amount for correcting the level.

12. The signal processing circuit for the electrostatic electroacoustic transducer according to claim 1, wherein the level corrector is configured to correct a non-linearity of the level.

13. An electrostatic electroacoustic transducer device, comprising:

a single driven electrostatic electroacoustic transducer including a diaphragm and a fixed electrode disposed to face the diaphragm; and a signal processing circuit configured to correct signals input to the electrostatic electroacoustic transducer, wherein the signal processing circuit is a signal processing circuit for the electrostatic electroacoustic transducer of claim 1.

14. A signal processing method executed by a signal processing circuit configured to correct signals input to a single driven electrostatic electroacoustic transducer comprising a diaphragm and a fixed electrode disposed to face the diaphragm, the signal processing method including:

determining a correction value based on a level of an input signal from a sound source; and correcting the level of the input signal based on the correction value, wherein correcting corrects the level of the input signal displacing the diaphragm to a first direction side on which the fixed electrode is not disposed with respect to a predetermined position, among the signals.

* * * * *